US010710845B2

(12) United States Patent
Ripping et al.

(10) Patent No.: US 10,710,845 B2
(45) Date of Patent: Jul. 14, 2020

(54) METHOD OF HANDING OVER A LOAD, AND AN ARRANGEMENT TO HAND OVER A LOAD

(71) Applicant: Heerema Marine Contractors Nederland SE, Leiden (NL)

(72) Inventors: Maarten Arie Ripping, Leiden (NL); Cornelis Benard, Leiden (NL)

(73) Assignee: HEEREMA MARINE CONTRACTORS NEDERLAND SE, Leiden (NL)

( * ) Notice: Subject to any disclaimer, the term of this patent is extended or adjusted under 35 U.S.C. 154(b) by 0 days.

(21) Appl. No.: 16/346,193

(22) PCT Filed: Nov. 6, 2017

(86) PCT No.: PCT/NL2017/050715

§ 371 (c)(1),
(2) Date: Apr. 30, 2019

(87) PCT Pub. No.: WO2018/084709

PCT Pub. Date: May 11, 2018

(65) Prior Publication Data

US 2019/0292019 A1 Sep. 26, 2019

(30) Foreign Application Priority Data

Nov. 7, 2016 (NL) ..... 2017736

(51) Int. Cl.
*B63B 27/32* (2006.01)
*B66C 1/10* (2006.01)
*B66C 23/52* (2006.01)

(52) U.S. Cl.
CPC ..... *B66C 1/10* (2013.01); *B63B 27/32* (2013.01); *B66C 23/52* (2013.01)

(58) Field of Classification Search
CPC ..... B66C 1/10; B66C 23/52; B63B 27/32
(Continued)

(56) References Cited

U.S. PATENT DOCUMENTS 7,882,794 B2 * 2/2011 Baylot ..... B63B 27/08 114/312
8,235,228 B2 * 8/2012 Vasstrand ..... B63B 27/10 212/256

(Continued)

FOREIGN PATENT DOCUMENTS

CN 102128311 B 10/2012
EP 2907786 A1 8/2015
KR 20160085609 A 7/2016

OTHER PUBLICATIONS

International Search Report and Written Opinion dated Jan. 29, 2018 for Application No. PCT/NL2017/050715.
Search Report dated Jul. 3, 2017 for Application No. NL 2017736.

*Primary Examiner* — Lynn E Schwenning
(74) *Attorney, Agent, or Firm* — Patterson + Sheridan, LLP

(57) ABSTRACT

The present invention provides a method to hand over a load, in particular when submerged, from a first hoisting device to a second hoisting device, comprising the steps of: providing a rigid intermediate device having a first connection point and a second connection point, wherein the first connection point and the second connection point are spaced with respect to each other with a distance of at least 5 meters, and wherein the intermediate device is configured to be connected to the load, connecting the load to the intermediate device, connecting the first hoisting device to the first connection point, suspending the load completely from the first hoisting device, connecting the second hoisting device to the second connection point, and—transferring the load from the first hoisting device to the second hoisting device, (Continued)

Figure 1:
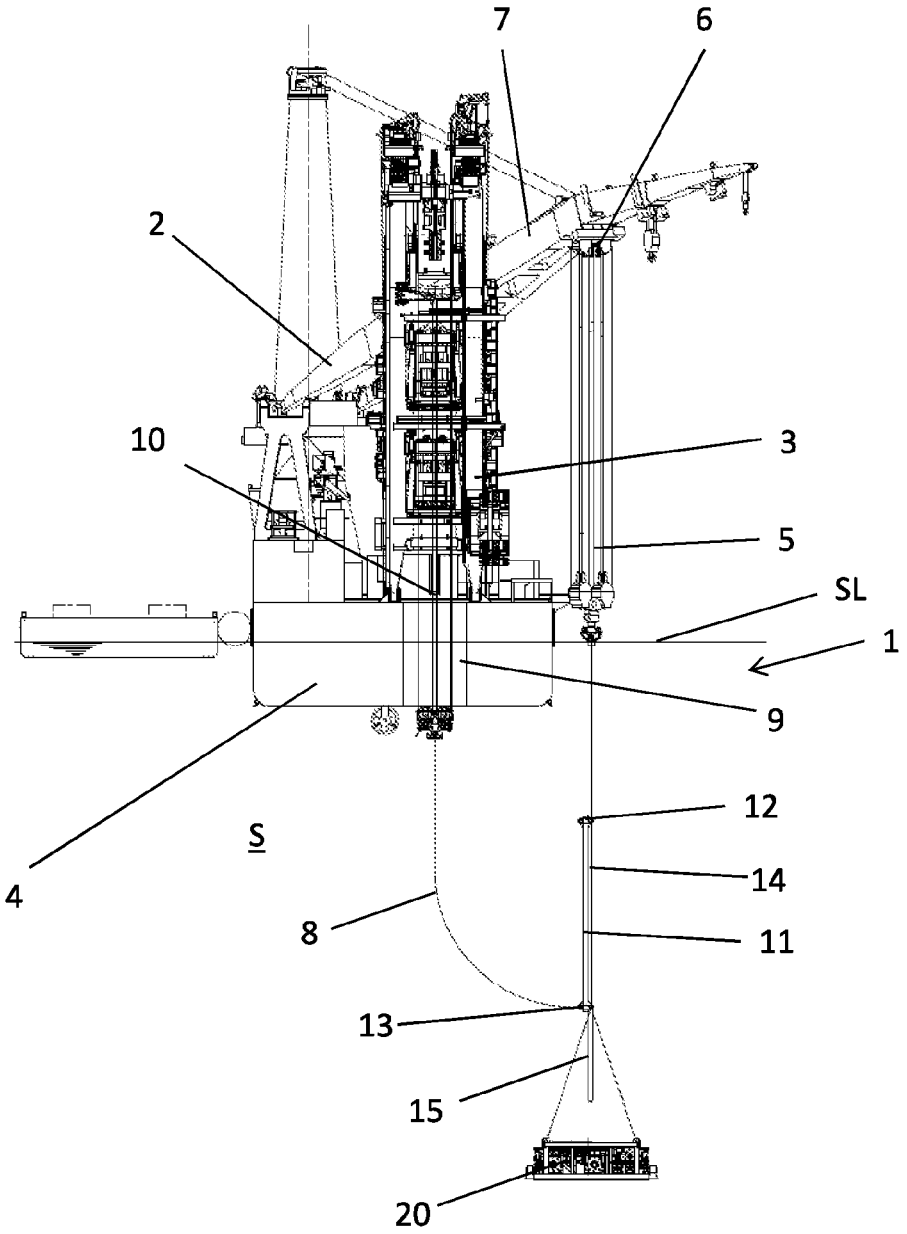

until the load is completely suspended from the second hoisting device.

17 Claims, 4 Drawing Sheets

(58) Field of Classification Search
USPC ..... 414/141.6
See application file for complete search history.

(56) References Cited

U.S. PATENT DOCUMENTS

| | | | | |
|---|---|---|---|---|
| 8,414,241 | B2 * | 4/2013 | Laenge | B66C 13/02 414/137.7 |
| 2007/0177944 | A1 * | 8/2007 | Smith | F16L 1/202 405/169 |
| 2010/0189541 | A1 * | 7/2010 | Laenge | B66C 13/02 414/803 |
| 2012/0156003 | A1 * | 6/2012 | Battersby | B63B 27/10 414/803 |

* cited by examiner

METHOD OF HANDING OVER A LOAD, AND AN ARRANGEMENT TO HAND OVER A LOAD

The present invention relates to an offshore method to hand over a load, in particular a submerged load, from a first hoisting device to a second hoisting device.

In offshore operations it may be desirable to hand over a load from a first hoisting device to a second hoisting device, for example from a first crane on a first vessel to a second crane on a second vessel.

In a known method to hand over a load, use is made of a triangle plate in the rigging arrangement that is connected to the load as well as both hoisting devices. The dimensions of such a triangle plate are limited to keep it practical in size and weight.

In some operations for handing over a load, there may be a considerable distance between a lifting location of the first hoisting device and a lifting location of the second hoisting device and/or a construction, such as a vessel construction which may hinder transfer of the load between the first hoisting device and the second hoisting device.

For example, it may be desirable to hold a load by a deep sea lowering system in order to enable the deep sea lowering system to lower the load to a deep sea level. When the hoisting element, for example a hoisting wire, of the deep sea lowering system passes through a moon pool, but the load does not fit or does not easily fit through the moon pool, the load has to be handed over to the deep sea lowering system, while the load is submerged. The load may for example be held below sea level by a crane arranged on the same or another vessel, with the hoisting element, for example a hoisting wire running at the side of the vessel into the sea. In order to transfer the load from the crane to the deep sea lowering system, the load is also connected, for example using a triangle plate, to the hoisting element of the deep sea lowering system so that the load force can be taken over by lifting the hoisting element of the deep sea lowering system and/or by lowering the hoisting element of the crane.

Since a part of the vessel is between the moon pool and the side of the vessel, this means that in the known method the load has to be lowered to a substantial depth into the sea before actual hand-over of the load between from the crane and the deep sea lowering system is possible, since otherwise the hoisting elements will clash with the vessel structure during the hand over.

A drawback of the known method is therefore that to hand over a load from a first hoisting device to a second hoisting device, the load may have to be brought to a relatively large depth in order to enable transfer of a load from a first hoisting device to the second hoisting device. One of the hoisting devices may not be suitable to be lowered to such a large depth, for instance, a reeving of the crane wires over a large number of sheaves/falls will allow a large load to be lifted, but at the same time will limit the depth that can be reached as the length of the crane wire will become governing for this. Also, lowering a hoisting element that is reeved in a large number of falls is a relatively slow and time consuming process. Thereby, at larger depth, the position and/or orientation of the load may be more difficult to control.

It is an aim of the invention to provide an improved method and/or arrangement to transfer a load, when submerged, from a first hoisting device to a second hoisting device which are laterally spaced apart.

The invention provides a method as claimed in claim 1.

In accordance with the method of the invention, a rigid intermediate device is used that may improve control of the transfer of the load from the first hoisting device to the second hoisting device. Also, the transfer of the load may be carried out at a smaller depth below sea level.

The intermediate device comprises a first connection point connected or to be connected with a flexible elongate hoisting element of the first hoisting device and a second connection point connected or to be connected to a flexible elongate hoisting element of the second hoisting device. The hoisting element may for example comprise one or more hoisting wires, lines, pipes, chains, etc.

The first connection point and the second connection point are spaced with respect to each other. The distance between the first connection point and the second connection point may be at least 5 meters, preferably at least 10 meters, more preferably at least 15 meters.

The intermediate device is connected with one or more connection elements to the load.

Before transfer of the load, the load is sub merged and completely suspended from the first hoisting device, and connected with a slack hoisting element, such as a wire, to the second hoisting device.

To transfer the load, the first connection point may be lowered with the first hoisting device and/or the second connection point may be lifted with the second hoisting device until the load is completely suspended from the second hoisting device. In an embodiment, the second connection point is lifted until the second connection point is at substantially the same height as the first connection point, and thereafter the first connection point is lowered to transfer the load completely to the second hoisting device.

During the transfer of the load, the intermediate device will tilt due to the relative movement of the first connection point with respect to the second connection point. This tilting of the intermediate device causes a lateral shift of the load from a position below a lifting location of the first hoisting device to a position below a lifting location of the second hoisting device. The lifting location of the first or second hoisting device is the location where the flexible hoisting element of the respective hoisting device is connected to the rigid construction of the hoisting device. The term lifting location is used to indicate a vertical line along which a flexible hoisting element of a hoisting device will hang when only a gravity force is exerted on the hoisting element.

In an embodiment, the method comprises after the step of transferring the load from the first hoisting device to the second hoisting device, the step of releasing the first hoisting device from the first connection point.

When the load is completely suspended from the second hoisting device, it may be desirable that the first hoisting device is released from the first connection point, such that the load is also no longer connected to the first hoisting device, for example in order to lower the load to a larger depth without the need of lowering hoisting elements of both the first hoisting device and the second hoisting device. However, in some embodiments, it may be desirable to keep the first hoisting device connected to the first connection point, while the hoisting element of the first hoisting device is kept slack. This may for instance be the case when at a later stage it is desirable to transfer the load, or a part thereof, back from the second hoisting device to the first hoisting device.

It is remarked that the flexibility of the rigid intermediate device is substantially smaller with respect to the hoisting elements of the first and second hoisting devices. The hoisting elements are for example hoisting wires, lines, pipes, chains, etc.

In an embodiment, the method comprises the step of adjusting a horizontal distance between a lifting location of the first hoisting device and a lifting location of the second hoisting device to substantially correspond to a distance between the first connection point and the second connection point of the intermediate device, before the step of transferring the load from the first hoisting device to the second hoisting device. This can for instance be achieved by adjusting the position of one or both of the hoisting devices. By adjusting the horizontal distance between the lifting location of the first connection point and the lifting location of the second connection point, the intermediate device will more efficiently guide the lateral shift of the load during transfer of the load. The horizontal distance is at least 5 meters, preferably at least 15 meters.

In an embodiment, the connection between the load and the intermediate device is designed such that a load force of the load is approximately equally distributed over the first hoisting device and the second hoisting device, when the first connection point and the second connection point are arranged at the same height. The load is approximately equally distributed over the first hoisting device and the second hoisting device, when the load force held by the first hoisting device is 40-60% of the complete load force and the rest of the load force is held by the second hoisting device.

During transfer of the load from the first hoisting device to the second hoisting device, it is desirable that the load will make a gradual lateral shift from a position below the lifting location of the first hoisting device to a position below the lifting location of the second hoisting device. By designing the connection between the load and the intermediate device such that a load force of the load is approximately equally distributed over the first hoisting device and the second hoisting device, when the first connection point and the second connection point are arranged at the same height, such gradual lateral shift of the load may be obtained. The connection may for example comprise one connection element connected to a third connection point in the middle between the first connection point and the second In an embodiment, the load is connected by a first connection element to the first connection point and by a second connection element the second connection point. In order to distribute the load force approximately equally over the first hoisting device and the second hoisting device, the load may be connected by connection elements, such as wires, lines, or chains to both the first connection point and the second connection point.

In an embodiment, the first connection element and the second connection element have approximately the same length. Further, the length of each of the first and second connection element can be 0.5-3 times, preferably 1-2 times the distance between the first connection point and the second connection point.

It should be noted, that the actual connection device to connect the first connection element to the intermediate device may be different than the actual connection device for the first hoisting device. The same first connection point here means that the connection of the first hoisting device and the first connection element are relatively close to each other on the intermediate device compared to the distance to the second connection point. For example the first connection point may be one end of a spreader bar, where both the first hoisting device and the first connection element are connected. Correspondingly, the actual connection device to connect the second connection element to the intermediate device may be different than the actual connection device for the second hoisting device, but, in that case, the connection of the second hoisting device and the second connection element to the intermediate device are relatively close to each other compared to the distance to the first connection point.

The first connection point may also comprise a single connection device to connect both the first hoisting device and the first connection element, and the second connection point may be a single connection device to connect both the second hoisting device and the second connection element.

In an embodiment, the first connection element is flexible and/or the second connection element is flexible. Flexible connection elements are for example wires, lines or chains.

In an alternative embodiment, the first connection element and/or the second connection element each comprises two or more rigid bars or beams that are pivotably and serially linked to each other.

In an embodiment, the step of connecting the second hoisting device to the second connection point is carried out during the step of suspending the load completely from the first hoisting device.

In an embodiment, the method comprises the step of submerging the load into water, before the step of transferring the load from the first hoisting device to the second hoisting device are arranged on two separate vessels. The method of the invention is designed for offshore applications in which a load is transferred from a first hoisting device to a second hoisting device, when this load is submerged in the sea. However, the method may start while the load is still above sea level, for instance arranged on a deck of a vessel. For example, the steps of providing a rigid intermediate device, connecting the load to the intermediate device, and connecting the first hoisting device to the first connection point may be carried out before the load is submerged into the sea.

The method of the invention may be used to transfer a load suspended from a first hoisting device, for example a first crane, arranged on a first vessel and a second hoisting device, for example, a second crane arranged on a second vessel. The method is in particular suitable when during hand over of the load a lateral shift of the load is required. This may be the case when it is not possible to bring the lifting location of the first hoisting device and the lifting location of the second hoisting device close to each other, for example since the first and second vessel cannot be arranged sufficiently close to each other.

The length of the lateral shift may for example be at least 5 meters, preferably at least 10 meters, more preferably at least 15 meters.

In an embodiment, one of the first hoisting device and the second hoisting device is a crane and the second of the first hoisting device and the second hoisting device is a deep sea lowering system of a vessel.

In an embodiment, the first hoisting device is arranged on a vessel having a moon pool, wherein an elongate hoisting element of the first hoisting device runs through the moon pool, and wherein an elongate hoisting element of the second hoisting device is arranged at a location horizontally spaced from the moon pool.

In an embodiment, the intermediate device is a spreader bar. A spreader bar having an elongate shape may advantageously be used as an intermediate device. One end of the spreader bar may be provided with the first connection point and the other opposite end of the spreader bar may be provided with the second connection point.

In alternative embodiments, any object providing a rigid connection between a first and second connection point that are spaced with respect to each other may be used as the intermediate device. The intermediate device may for example be a beam or a plate.

The invention further provides a load transfer arrangement to hand over a load, when submerged, comprising a first hoisting device, a second hoisting device, and a rigid intermediate device, wherein the intermediate device comprises a first connection point and a second connection point, wherein the first connection point and the second connection point are spaced with respect to each other, wherein the first hoisting device is connected to the first connection point, wherein the second hoisting device is connected to the second connection point, and wherein the load is connected to the intermediate device, wherein the load transfer arrangement is configured to carry out the method of any of the claims 1-13.

In an embodiment of the arrangement, a horizontal distance between a lifting location of the first hoisting device and a lifting location of the second hoisting device substantially corresponds to a distance between the first connection point and the second connection point.

In an embodiment, the horizontal distance is at least 5 meters, preferably at least 15 meters.

In an embodiment, the connection between the load and the intermediate device is selected such that a load force of the load is approximately equally distributed over the first hoisting device and the second hoisting device, when the first connection point and the second connection point are arranged at the same height.

In an embodiment wherein the load is connected with a first connection element to the first connection point and with a second connection element to the second connection point.

In an embodiment, the first connection element is flexible and/or wherein the second connection element is flexible. Flexible connection elements are for example wires, lines or chains.

In an alternative embodiment, the first connection element and/or the second connection element each comprises two or more rigid bars or beams that are pivotably and serially linked to each other.

Figure 2B:
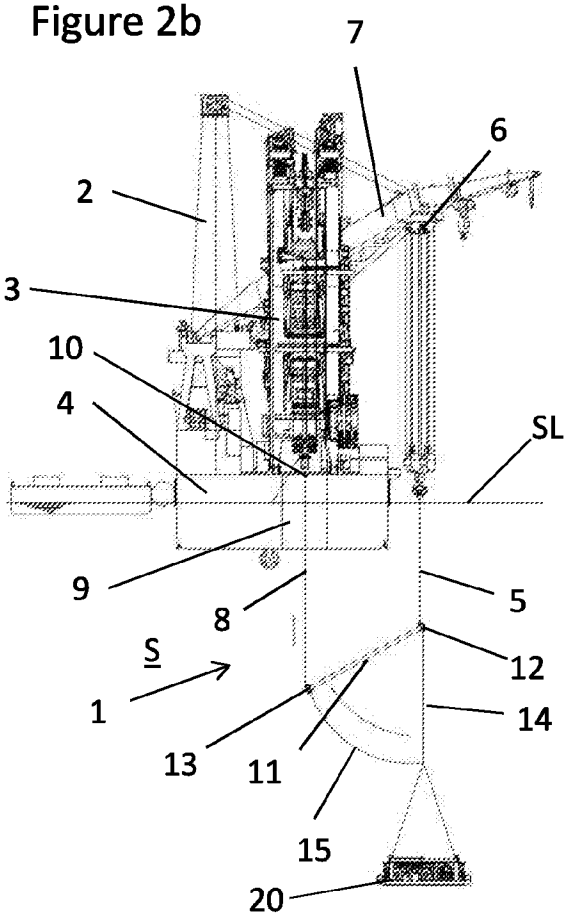
Figure 2A:
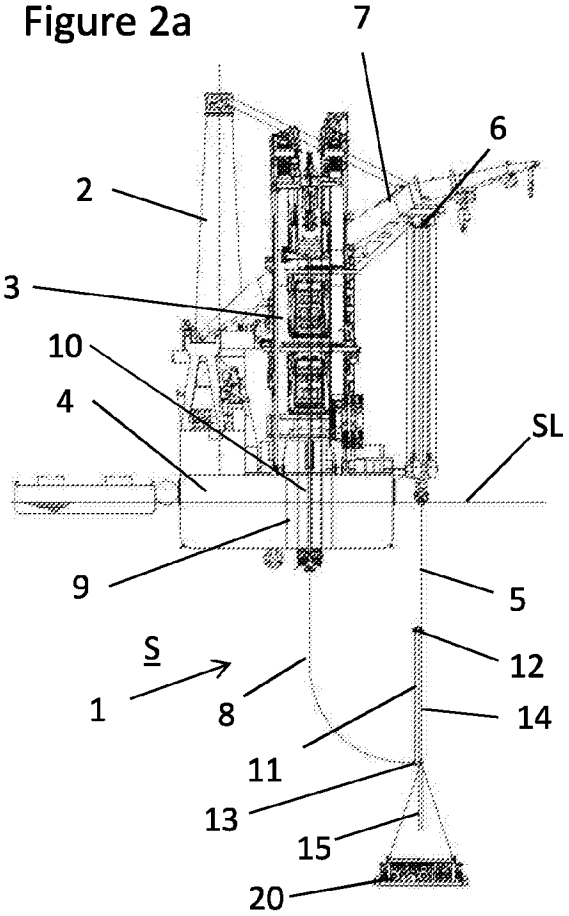
Figure 2D:
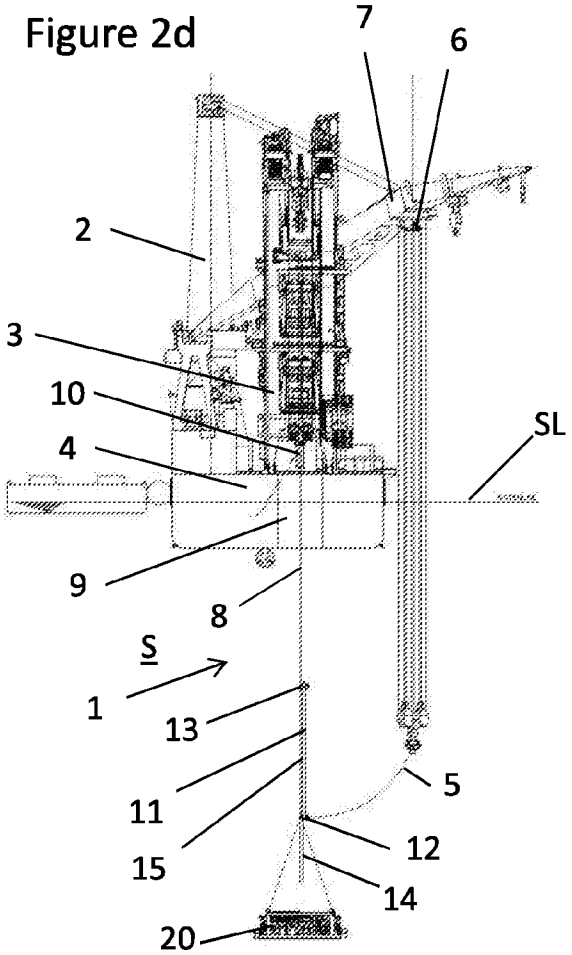
Figure 2C:
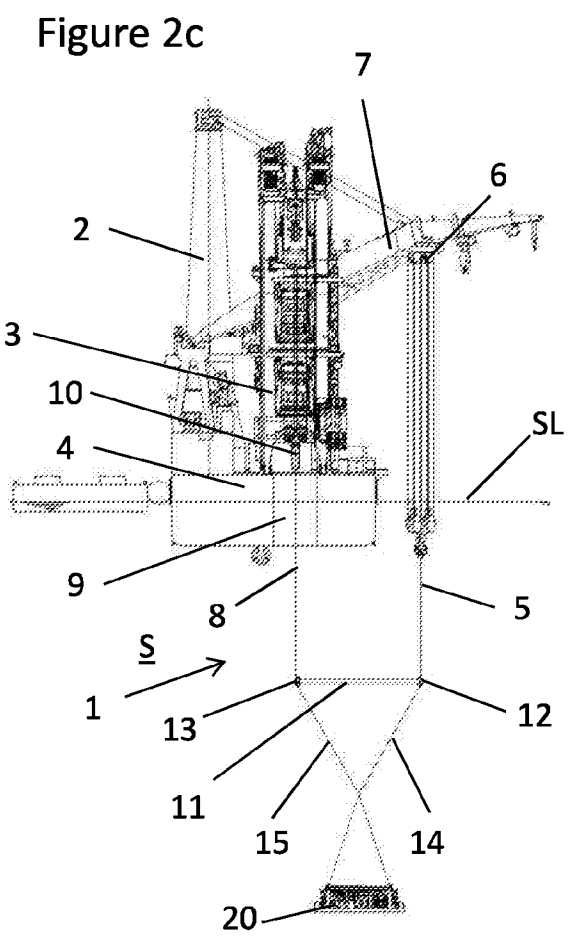
Figure 3:
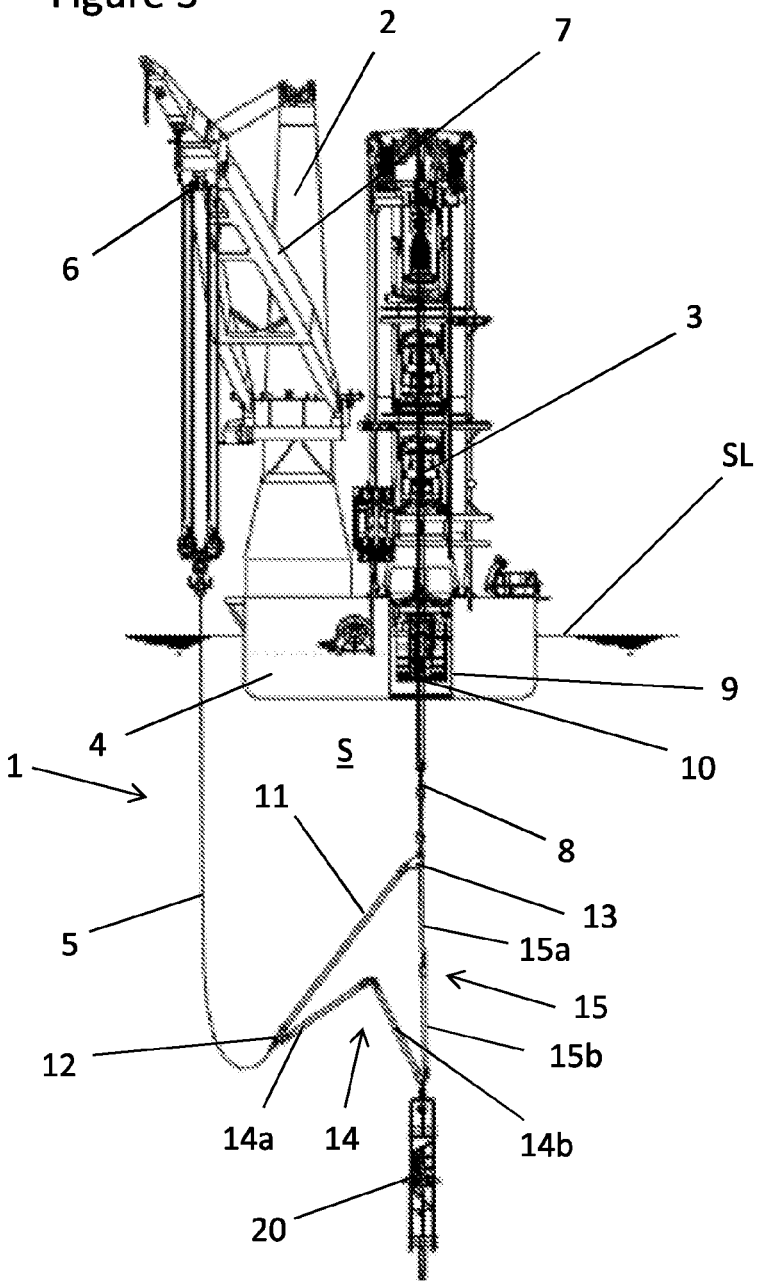

Embodiments of the invention will now be described, by way of example only, with reference to the accompanying schematic drawings in which:

FIG. 1 shows a first embodiment of a load transfer arrangement;

FIGS. 2*a*-2*d* show steps of an embodiment of the method of the invention using the load transfer arrangement shown in FIG. 1; and FIG. 3 shows a second embodiment of a load transfer arrangement.

FIG. 1 shows a load transfer arrangement, generally denoted by reference numeral 1. The arrangement 1 comprises a first hoisting device 2 and a second hoisting device 3. The first hoisting device 2 and the second hoisting device 3 are both arranged on a vessel 4, in particular a deep dead construction vessel.

The arrangement 1 is configured to transfer a load 20 from the first hoisting device 2 to the second hoisting device 3.

The first hoisting device 2 is a crane having a flexible elongate hoisting arrangement 5 formed by a number of lifting wires, a crane hook, and rigging suspended from the hook. From a lifting location 6, the hoisting element 5 is suspended from a crane boom 7. The crane shown in FIG. 2 is a revolving mast type crane, but may also be any other suitable type of crane. The position of the lifting location 6 of the crane may be adjusted by rotation of the crane.

The second hoisting device 3 is a deep sea lowering system arranged on the vessel 4. The deep sea lowering system is for example a deep water lowering system with one or more wires that are routed through a pipelay tower. The deep sea lowering system also comprises a flexible elongate hoisting element 8 that runs through a moon pool 9 in the vessel 4. The lifting location 10 of the second hoisting device 3 is the location where the hoisting element is connected to the rigid construction of the second hoisting device 3.

The load transfer arrangement 1 further comprises an elongate spreader bar 11 having a first connection point 12 at a first end of the spreader bar 11 and a second connection point 13 at the opposite end of the spreader bar 11. Thus the first connection point 12 and the second connection point 13 are spaced with respect to each other over almost the entire length of the spreader bar 11.

The hoisting element 5 of the first hoisting device 2 is connected to the first connection point 12 of the spreader bar 11 and the hoisting element 8 of the second hoisting device 3 is connected to the second connection point 13 of the spreader bar 11.

The load 20 is connected to the spreader bar 11, whereby a first flexible connection element 14, for example a wire, chain or line, is connected to the first connection point 12 and a second flexible connection element 15, for example a wire, chain or line, connected to the second connection point 13. The first flexible connection element 14 and the second flexible connection element 15 are of substantially the same length. As a result, a load force of the load 20 is approximately equally distributed over the first hoisting device 2 and the second hoisting device 3 when the first connection point 12 and the second connection point 13 are arranged at the same height.

It is remarked that the length of each of the first and second flexible connection element 14, 15 may be 0.5-3 times, preferably 1-2 times the distance between the first connection point 12 and the second connection point 13.

It will be clear, however, that in the state shown in FIG. 1, the load 20 is completely carried by the first hoisting device 2.

The arrangement 1 may be used to transfer a load 20 from the first hoisting device 2 to the second hoisting device 3, whereby the lifting location 6 of the first hoisting device 2 and the lifting location 10 of the second hoisting device 3 are at a horizontal distance from each other. Due to the horizontal distance, the load has to make a lateral shift to be transferred from a position below the lifting location 6 of the first hoisting device 2 to a position below the lifting location 10 of the second hoisting device 3.

In the shown embodiment, the load 20 is to be suspended from the second hoisting device 3 in order to make it possible to lower the load 20 to a deep sea location. Since the load 20 comprises a package that cannot be moved or at least not easily be moved through the moon pool 9, the load 20 first has to be submerged next to the vessel into the sea S using a different hoisting device, in this case the first hoisting device 2. When the load 20 is submerged into the sea the above-mentioned lateral shift should be carried out in order to hold the load by the second hoisting device 3 and below the lifting location 10 of the second hoisting device 3.

As will be explained hereinafter, the presence of the spreader bar 11 provides a controlled lateral shift of the load 20. Also, this lateral shift of the load 20 can be carried out at a relatively low depth below sea level SL.

FIGS. 2*a*-2*d* show the load transfer arrangement 1 during the steps of the method of the invention.

FIG. 2*a* corresponds to the state of the load transfer arrangement shown in FIG. 1.

In the state shown in FIG. 1, the load 20 is submerged into the sea S at a larger depth than the bottom of the vessel 4. The load 20 is completely suspended from the first hoisting device 2 via hoisting element 5 and the first flexible connection element 14 that are both connected to the first connection point of the spreader bar 11. The load 20 is also connected with the second flexible connection element 15 to the second connection point 13 of the spreader bar 12, but the second flexible connection element 15 is slack.

The hoisting element 8 of the second hoisting device 3 is already connected to the second connection point 13, but no substantial lifting force is exerted by the second hoisting device 3 on the load 20.

As a result, the load 20 is arranged at a position below the lifting location 6 of the first hoisting device 2.

FIG. 2*b* shows the arrangement 1 during the first part of the transfer of the load from the first hoisting device 2 to the second hoisting device 3. The second connection point 13 of the spreader bar 11 is pulled upwards by a lifting action of the second hoisting device 3. This results in a tilting of the spreader beam 11 from a vertical position towards a horizontal position.

In FIG. 2*b*, the second flexible connection element 15 is however still slack and the load 20 is completely suspended from the first hoisting device 2. The load 20 is still arranged at a position substantially below the lifting location 6 of the first hoisting device 2.

When the second hoisting device 3 continues to pull the second connection point 13 upwards, the second flexible connection element 15 will become taut and the load 20 will start to make a lateral shift since the load 20 is gradually taken over by the second hoisting device 3.

FIG. 2*c* shows the transfer of the load halfway. The load 20 has now made a lateral shift until half way between a position below the lifting location 6 of the first hoisting device 2 and a position below the lifting location 10 of the second hoisting device 3.

In FIG. 2*c* it can be seen that the first connection point 12 and the second connection point 13 of the spreader bar 11 are at the same height. Since the first flexible connection element 14 and the second flexible connection element 15 have substantially the same length, the load force is equally distributed over the first hoisting device 2 and the second hoisting device 3.

Further, it can be seen that the distance between the first connection point 12 and the second connection point 13 of the spreader bar 11 substantially corresponds to a horizontal distance between the lifting location 6 of the first hoisting device 2 and the lifting location 10 of the second hoisting device 3. The first connection point 12 is arranged at a position below the lifting location 6 of the first hoisting device 2 and the second connection point 13 is arranged at a position below the lifting location 10 of the second hoisting device 3.

This provides an efficient use of the respective hoisting elements 5, 8, and a controlled hand-over of the load from the first hoisting device 2 to the second hoisting device 3, the horizontal distance between the lifting location 6 of the first hoisting device 2 and the lifting location 10 of the second hoisting device 3 has been adjusted before carrying out the transfer of the load 20 to substantially correspond to a distance between the first connection point 12 and the second connection point 13.

From the state shown in FIG. 2*c*, the first connection point 12 of the spreader bar 11 is lowered by the first hoisting device 2 to continue hand over of the load 20 from the first hoisting device 2 to the second hoisting device 3. Alternatively or in combination, the second connection point 13 could be lifted by the second hoisting device 3 to achieve the same result.

This lowering is continued until the load 20 is completely suspended from the second hoisting device 3.

It is remarked that in the state as shown in FIG. 2*c*, also the hoisting element 5 and the hoisting element 8 can be simultaneously lowered or lifted in order to move the load 20 downwards or upwards, respectively. It will be clear that the load force will be distributed over the first hoisting device 2 and the second hoisting device 3.

FIG. 2*d* shows the arrangement 1 when the load is completely suspended from the second hoisting device 3. The first hoisting element 5 and the first flexible connection element 14 are slack.

The hoisting element 5 of the first hoisting device 2 may now be released from the first connection point so that the first hoisting device 2 is no longer connected to the spreader bar 11 and therewith to the load 20. The second hoisting device 3 can now be used to lower the load to a large depth in the sea using the specific equipment of the deep sea lowering system.

When desired, the load or at least part thereof may be transferred back to the first hoisting device 2, for example after a certain operation has been carried out. It will be clear that when the first hoisting device 2 was released from the spreader bar 11, the first hoisting device 2 first has to be reconnected at the first connection point 12, before transfer of the load from the second hoisting device 3 to the first hoisting device 2 may be carried out. The transfer may then be realized by lifting of the first connection point 12 up to the same level as the second connection point 13 and subsequent lowering of the second connection point 13, until the load is completely suspended from the first hoisting device 2.

FIG. 3 shows an alternative embodiment of a load transfer arrangement. The same part of parts having the same function are denoted by the same reference numerals. The main difference with the embodiment of FIGS. 1 and 2*a*-2*d* is that the first connection element 14 and the second connection element 15 are not provided as flexible elements. The first connection element 14 comprises two connection sub-elements 14*a*, 14*b* that are pivotably and serially linked to each other. The second connection element 15 also comprises two connection sub-elements 15*a*, 15*b* that are pivotably and serially linked to each other.

In FIG. 3, the load 20 is completely suspended from the second hoisting device 3, similar to the state of FIG. 2*d*. The two connection sub-elements 15*a*, 15*b* are pulled vertically in line by the load 20. The two connection sub-elements 14*a*, 14*b* of the first connection element 14 are hinged at an angle instead of being slack.

It is remarked that the two connection sub-elements 14*a*, 14*b* may be folded further towards each other until the two connection sub-elements 14*a*, 14*b* are substantially parallel.

To transfer the load 20 from the second hoisting device first 3 to the first hoisting device 2, lifting of the first hoisting element 5 and/or lowering of the second hoisting element 8, will first result in the two connection sub-elements 14*a*, 14*b* being pulled straight, similar to the flexible connection 14 of the embodiment of FIGS. 1 and 2*a*-2*d*. Thereafter, the load 20 will make a lateral shift from a position below lifting location 10 to a position below lifting location 6 and the load will completely be suspended from the first hoisting device 2. When lifting of the first hoisting element 5 and/or lowering of the second hoisting element 8 is still continued, the second connection element 15 may be folded by hinging of the two connection sub-elements 15*a*, 15*b* with respect to each other. Similar to connection sub-elements 14*a*, 14*b*, the two connection sub-elements 15*a*, 15*b* may be folded together until the two connection sub-elements 15*a*, 15*b* are substantially parallel. This results in an elongate collapsed configuration of the combination of the spreader bar 11, first connection element 14 and second connection element 15, that for example can easily be stored on the deck of the vessel 4.

Hereinabove, an embodiment has been described in which the first hoisting device 2 and the second hoisting device 3 are arranged on the same vessel. A similar method may be used to transfer a load from a first hoisting device arranged on a first vessel to a second hoisting device arranged on a second vessel, in particular when such transfer requires a lateral shift of the load from a position under a lifting location of the first hoisting device to a position under a lifting location of the second hoisting device. Such situation may for instance occur when the first and second vessel are not able to approach each other sufficiently close in order to transfer the load without such lateral shift.

The invention claimed is:

1. A method to hand over a load, in particular when submerged, from a first hoisting device to a second hoisting device, comprising the steps of:

providing a rigid intermediate device having a first connection point and a second connection point, wherein the first connection point and the second connection point are spaced with respect to each other, and wherein the intermediate device is configured to be connected to the load, connecting the load to the intermediate device, connecting the first hoisting device to the first connection point, suspending the load completely from the first hoisting device, connecting the second hoisting device to the second connection point, and transferring the load from the first hoisting device to the second hoisting device, until the load is completely suspended from the second hoisting device.

2. The method of claim 1, comprising the step of adjusting a horizontal distance between a lifting location of the first hoisting device and a lifting location of the second hoisting device to substantially correspond to a distance between the first connection point and the second connection point before the step of transferring the load from the first hoisting device to the second hoisting device.

3. The method of claim 2, wherein the horizontal distance is about 5 meters to about 15 meters.

4. The method of claim 1, wherein the connection between the load and the intermediate device is designed such that a load force of the load is approximately equally distributed over the first hoisting device and the second hoisting device, when the first connection point and the second connection point are arranged at the same height.

5. The method of claim 1, wherein the load is connected with a first connection element to the first connection point and with a second connection element to the second connection point.

6. The method of claim 5, wherein the first connection element is flexible and/or wherein the second connection element is flexible.

7. The method of claim 1, wherein the step of transferring the load from the first hoisting device to the second hoisting device comprises lowering the first connection point with the first hoisting device and/or lifting the second connection point with the second hoisting device.

8. The method of claim 7, wherein the step of connecting the second hoisting device to the second connection point is carried out during the step of suspending the load completely from the first hoisting device.

9. The method of claim 1, wherein the method comprises the step of submerging the load into water, before the step of transferring the load from the first hoisting device to the second hoisting device.

10. The method of claim 1, wherein one of the first hoisting device and the second hoisting device is a crane and the second of the first hoisting device and the second hoisting device is a deep sea lowering system of a vessel.

11. The method of claim 1, wherein the first hoisting device is arranged on a vessel having a moon pool, wherein an elongate hoisting element of the first hoisting device runs through the moon pool, and wherein an elongate hoisting element of the second hoisting device is arranged at a location horizontally spaced from the moon pool.

12. The method of claim 1, wherein the intermediate device is a spreader bar having a first end provided with the first connection point and a second opposite end provided with the second connection point.

13. A load transfer arrangement configured to carry out the method of claim 1, comprising the first hoisting device, the second hoisting device, and the rigid intermediate device, wherein the intermediate device comprises the first connection point and the second connection point, wherein the first connection point and the second connection point are spaced with respect to each other, wherein the first hoisting device is connected to the first connection point, wherein the second hoisting device is connected to the second connection point, and wherein the load is connected to the intermediate device.

14. The arrangement of claim 13, wherein a horizontal distance between a lifting location of the first hoisting device and a lifting location of the second hoisting device substantially corresponds to a distance between the first connection point and the second connection point.

15. The arrangement of claim 14, wherein the horizontal distance is about 5 meters to about 15 meters.

16. The arrangement of claim 13, wherein the connection between the load and the intermediate device is selected such that a load force of the load is approximately equally distributed over the first hoisting device and the second hoisting device, when the first connection point and the second connection point are arranged at the same height.

17. The arrangement of claim 13, wherein the load is connected with a first connection element to the first connection point and with a second connection element to the second connection point.

* * * * *